US011473263B2

(12) United States Patent
Dingman et al.

(10) Patent No.: US 11,473,263 B2
(45) **Date of Patent: *Oct. 18, 2022**

(54) SUCTION PILE COFFERDAM

(71) Applicant: Delta SubSea LLC, Montgomery, TX (US)

(72) Inventors: Scott P. Dingman, Montgomery, TX (US); Perry Loughridge, Montgomery, TX (US)

(73) Assignee: DELTA SUBSEA LLC, Montgomery, TX (US)

( * ) Notice: Subject to any disclaimer, the term of this patent is extended or adjusted under 35 U.S.C. 154(b) by 43 days.

This patent is subject to a terminal disclaimer.

(21) Appl. No.: 17/191,128

(22) Filed: Mar. 3, 2021

(65) Prior Publication Data

US 2021/0189682 A1 Jun. 24, 2021

Related U.S. Application Data

(63) Continuation of application No. 16/719,476, filed on Dec. 18, 2019, now Pat. No. 10,947,692.

(60) Provisional application No. 62/880,231, filed on Jul. 30, 2019.

(51) Int. Cl.
*E02D 29/09* (2006.01)

(52) U.S. Cl.
CPC ..... *E02D 29/06* (2013.01)

(58) Field of Classification Search
CPC combination set(s) only.
See application file for complete search history.

(56) References Cited

U.S. PATENT DOCUMENTS 4,408,405 A * 10/1983 Williams ..... E02D 7/24 37/322
5,382,115 A * 1/1995 Jones ..... F16L 55/18 405/226
2019/0145072 A1* 5/2019 Haigh ..... E02D 29/02 405/203

* cited by examiner

*Primary Examiner* — Kyle Armstrong
(74) *Attorney, Agent, or Firm* — Jason P. Mueller; FisherBroyles, LLP

(57) ABSTRACT

A cofferdam is disclosed that includes an open frame structure having double walls defining a hollow space within each double wall, with each double wall having an open bottom end and a closed top end. Each of the double walls are configured to act as suction piles allowing liquid to be removed from the space within each double wall to thereby induce negative pressure when the cofferdam is installed in a sub-sea configuration. Each of the double walls may include a plurality of partitions respectively defining a plurality of suction piles, the suction piles fluidically coupled by a manifold that may allow liquid to be removed from the suction pile to thereby drive the cofferdam structure into the subsea surface due to the induced negative pressure. A further embodiment cofferdam structure includes an open frame structure and one or more suction piles attached to the open frame structure.

11 Claims, 6 Drawing Sheets

SUCTION PILE COFFERDAM

CROSS-REFERENCE TO RELATED APPLICATIONS

The present application is a continuation of U.S. patent application Ser. No. 16/719,476, filed Dec. 18, 2019, which claims the benefit of U.S. Provisional Patent Application No. 62/880,231, filed Jul. 30, 2019, the entire contents of each of which are incorporated herein by reference.

BRIEF DESCRIPTION OF THE DRAWINGS

The accompanying drawings are part of this disclosure and are incorporated into the specification. The drawings illustrate example embodiments of the disclosure and, in conjunction with the description and claims, serve to explain various principles, features, or aspects of the disclosure. Certain embodiments of the disclosure are described more fully below with reference to the accompanying drawings. However, various aspects of the disclosure may be implemented in many different forms and should not be construed as being limited to the implementations set forth herein. Like numbers refer to like, but not necessarily the same or identical, elements throughout.

DETAILED DESCRIPTION

This disclosure generally relates to cofferdams having suction pile anchors. A convention cofferdam is a watertight enclosure that may be pumped dry to permit construction work below a waterline, as when building a bridge or repairing a ship. Cofferdams may also be used in sub-sea applications when sediment is needed to be removed from a subsea location. Suction piles (also known as suction caissons) are fixed platform anchors that are used as anchors for offshore installations, oil platforms, oil drilling platforms, etc. A conventional suction pile is essentially a large cylinder that is closed at one end. The structure is lowered to the ocean floor, with a downwardly facing open end, where the structure partially sinks into ocean-floor sediment of its own weight. Water is then pumped out of the structure causing a negative pressure inside the structure. The negative pressure forces the suction pile into the seabed sediment whereby the suction pile becomes strongly attached to the ocean floor and serves as an anchor. Once installed, the suction pile resists axial and lateral loads and may be used to secure mooring lines that are attached to the suction pile at various load points. As described in greater detail below, suction piles may be attached to a cofferdam structure or the cofferdam structure may include internal structures that may be used as suction piles to secure the cofferdam structure.

Figure 1:
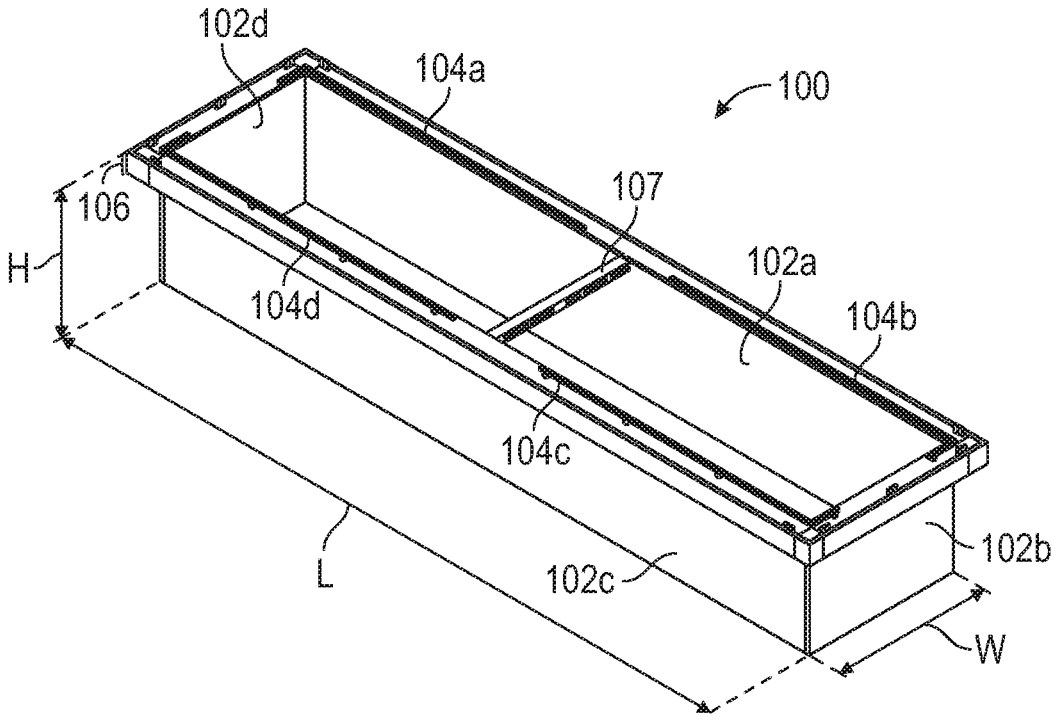
FIG. 1 is a three-dimensional perspective view of a cofferdam structure including suction piles, in accordance with one or more embodiments of the disclosure.

FIG. 1 is a three-dimensional perspective view of a cofferdam structure 100 including suction piles, in accordance with one or more embodiments of the disclosure. As described in greater detail below, cofferdam structure 100 includes double walls each having an open end at the bottom and a closed end at the top so that walls function as a suction pile. In this way, water may be partially or completely removed from the walls of cofferdam structure 100 so that induced negative pressure within the walls generates a net force that pushes cofferdam structure 100 into a sediment layer of the seabed. Cofferdam structure 100 may be used for deep sea operations when it is necessary to excavate sediment from an area of the sea floor for maintenance or installation of a subsea structure such as a drilling rig, an oil well, a pipeline, etc. Cofferdam structure 100 may also be used for undersea exploration, recovery of a shipwreck, recovery of sunken treasure, etc. In further embodiments, cofferdam structure 100 may be used for applications other than those requiring excavation from the sea floor. For example, cofferdam structure 100 may be used for oil/gas well decommissioning, well intervention, control and plugging of wells, abandoning wells, etc.

As illustrated in FIG. 1, cofferdam structure 100 includes four walls 102*a*, 102*b*, 102*c*, and 102*d* that form a rectangular open frame structure. Cofferdam structure 100 is characterized by a length L, a width W, and a height H. According to an embodiment, cofferdam structure 100 may have dimensions L=750 feet, W=150 feet, and H=120 to 150 feet. Walls 102*a* to 102*d* may be four-foot stud walls enclosing a hollow space in between, as described in greater detail below with reference to FIG. 4. Cofferdam structure 100 may further be configured to include an extended structure 106 (i.e., an overhang) around a top border region of cofferdam structure 100. In some embodiments, extended structure 106 may serve as a mud mat. Extended structure 106 may have height of from 20 to 50 feet and a width of approximately 20 feet. Other embodiments may have other dimensions for comparable features. Cofferdam structure 100 may further include a walkway 107 that may be used during maintenance or installation operations. Other embodiments may omit extended structure 106 and/or walkway 107.

As described in greater detail below, cofferdam structure 100 may include suction pile structures built into walls 102*a*, 102*b*, 102*c*, and 102*d*. As such, cofferdam structure 100 may be provided with suction pile equipment that is configured to allow removal of water from walls 102*a*, 102*b*, 102*c*, and

102*d*. As shown in FIG. 1, cofferdam structure 100 may include fluidic pipes or tubing 104*a* to 104*d* that may be configured to make a fluidic connection with internal spaces of walls 102*a* to 102*d*. Fluidic pipes or tubing 104*a* to 104*d* may further be connected by a manifold (not shown). An ROV may make one or more fluidic connections with fluidic pipes or tubing 104*a* to 104*d* through various pieces of suction pile equipment. In this way, an ROV may partially or completely pump water out of walls 102*a* to 102*d*. Use of an ROV, however, is only one method by which cofferdam structure 100 may be accessed, ballasted/de-ballasted, etc. In other embodiments, fluidic connections with fluidic pipes or tubing 104*a* to 104*d* of cofferdam structure 100 may be made using any suitable device such as a topside pump, a skid-mounted pump, a subsea pump, etc.

Figure 2:
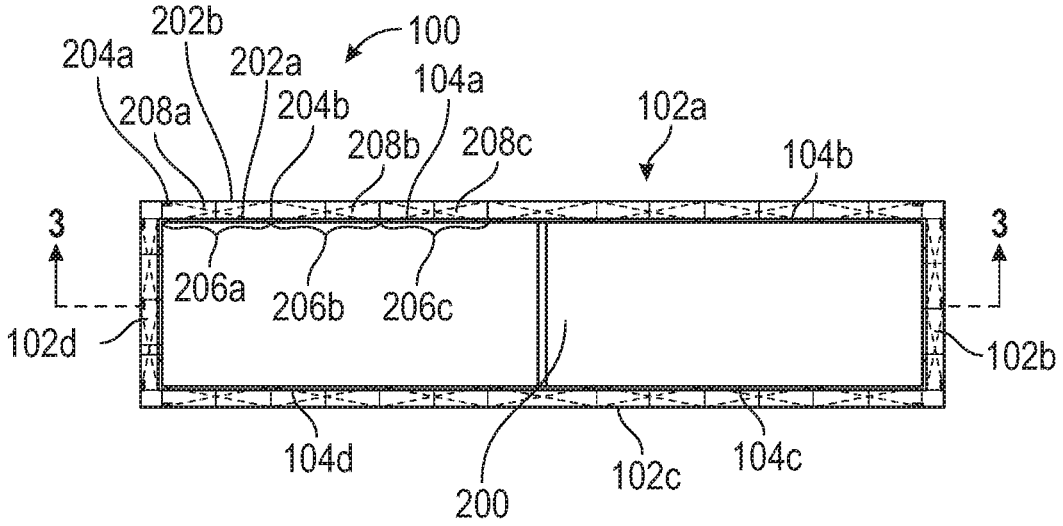
FIG. 2 is a top view of a cofferdam structure including suction piles, in accordance with one or more embodiments of the disclosure.

FIG. 2 is a top view of cofferdam structure 100 of FIG. 1, in accordance with one or more embodiments of the disclosure. Walls 102*a* to 102*d* enclose an open region 200. Once cofferdam structure 100 is installed on the seabed, sediment may be removed from region 200 as mentioned above. Each of walls 102*a* to 102*d* may be a double-walled structure having an inner wall 202*a* and an outer wall 202*b*. Further, the double-walled structure may be partitioned into a plurality of compartments by partition structures 204*a*, 204*b*, etc. In this way, each double-walled structure may be configured to include a plurality of hollow regions 206*a*, 206*b*, 206*c*, etc. Each of regions 206*a*, 206*b*, 206*c*, etc. may be provided with a closed top end structure 208*a*, 208*b*, 208*c*, etc., and a corresponding open bottom end structure (e.g., see open bottom 406 in FIG. 4). In this way, regions 206*a*, 206*b*, 206*c*, etc., may be configured to act as suction piles. Each of regions 206*a*, 206*b*, 206*c*, etc., may be fluidically coupled via fluidic pipes or tubing 104*a* to 104*d* so that water may be removed from regions 206*a*, 206*b*, 206*c*, etc., to thereby induce negative pressure within regions 206*a*, 206*b*, 206*c*, etc. Fluidic pipes or tubing 104*a* to 104*d* may further be connected by a manifold (not shown). FIG. 2 also defines a cross section 3-3 that is used to define the cross-sectional view of cofferdam structure 100 shown in FIG. 3, and described in greater detail below.

Figure 3:
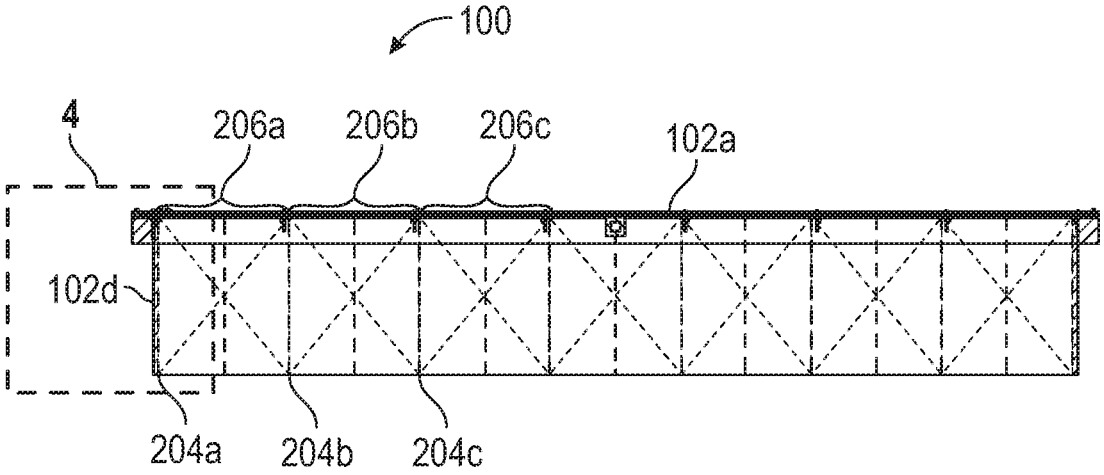
FIG. 3 is a cross-sectional view of a cofferdam structure including suction piles, in accordance with one or more embodiments of the disclosure.
Figure 4:
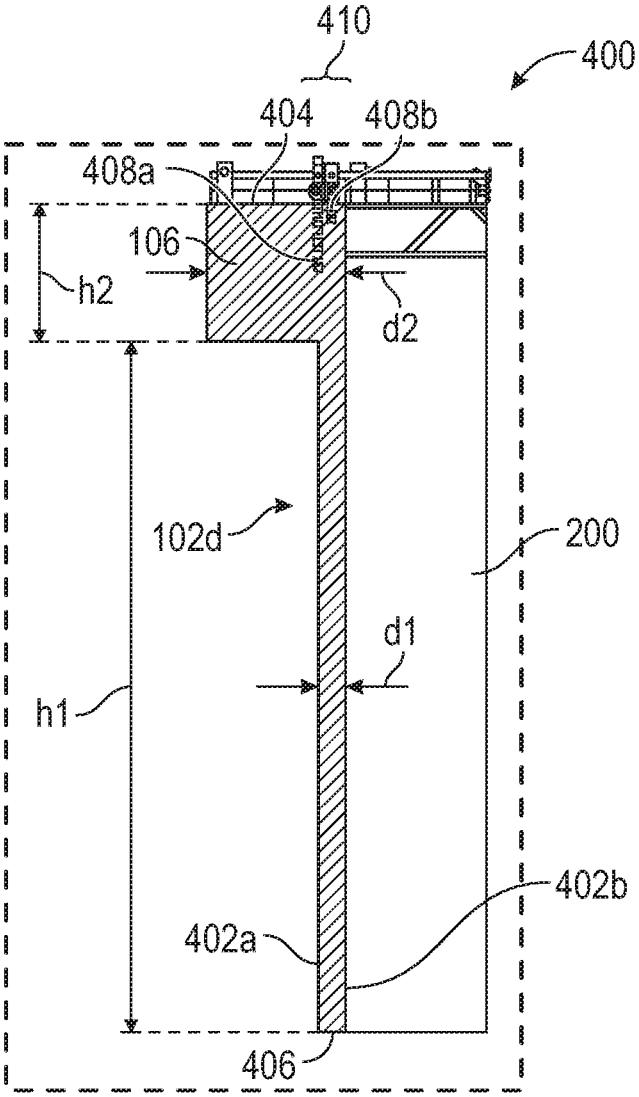
FIG. 4 is an enlarged cross-sectional view of an end wall of the cofferdam structure of FIG. 3, in accordance with one or more embodiments of the disclosure.

FIG. 3 is a cross-sectional view of cofferdam structure 100 including suction piles, in accordance with one or more embodiments of the disclosure. This cross-sectional view cuts through end wall 102*d* as shown in FIG. 4, and described in greater detail below. FIG. 3 also provides a side view of internal wall 102*a*. Although not shown in cross section, regions 206*a*, 206*b*, 206*c*, etc., of internal wall 102*a* are also indicated. Regions 206*a*, 206*b*, 206*c*, etc., are separated by internal partitions 204*a*, 204*b*, 204*c*, etc., to thereby form hollow spaces that may service as suction piles, as mentioned above and described in greater detail below.

FIG. 4 is an enlarged cross-sectional view 400 of end wall 102*d* of cofferdam structure 100 of FIG. 3, in accordance with one or more embodiments of the disclosure. End wall 102*d* includes an outer wall 402*a* and an inner wall 402*b* that forms a hollow space between walls 402*a* and 402*b*. Outer wall 402*a* is an externally facing wall and inner wall 402*b* faces internal region 200 (e.g., see FIG. 2). End wall 102*d* further includes a closed top 404 structure and an open bottom end 406. End wall 102*d* further includes extended structure 106, as described above. In this configuration, a suction pile is formed by a hollow region (e.g., shown as a hatched region) that includes a first hollow region of height h1 and second hollow region within extended structure 106 having height h2. The first hollow region may have thickness d1 and the second hollow region may have thickness d2. In an example embodiment, h1=100 feet, d1=4 feet, h2=20 feet, and d2=20 feet. Other embodiments may have other dimensions for comparable features.

The suction pile of FIG. 4 (i.e., hatched region of FIG. 4) may further be provided with one or more fluidic conduits. In this example, two fluidic conduits 408*a* and 408*b* are shown. Fluidic conduits 408 may have various configurations. For example, fluidic conduit 408*a* may have a first length that extends into extended structure 106 and fluidic conduit 408*b* may have a second length. In this example, the first length is longer than the second length. In other embodiments, both fluidic conduits 408*a* and 408*b* may have a common length. Other embodiments may have greater or fewer fluidic conduits. In this example, fluidic conduits 408*a* and 408*b* are shown as perforated pipes that are configured to allow water to flow through a plurality of apertures. Perforated pipes may be advantageous for use in water that contains mud and/or other sediment. In this regard, perforated pipes may be less prone to clogging due to mud and/or other sediment than pipes that are not perforated. Other embodiments may have fluidic conduits 408*a* and 408*b* having smooth surfaces with a single opening at a distal end of each fluidic conduit (not shown).

Fluidic conduits 408*a* and 408*b* may be fluidically coupled to suction pile equipment 410 that may allow an ROV or other external device to couple to fluidic conduits 408*a* and 408*b*. For example, a pump provided by an ROV may be configured to fluidically couple to fluidic conduits 408*a* and 408*b* and to pump water out of the suction pile structure. In other embodiments, fluidic connections with fluidic conduits 408*a* and 408*b* may be made using any suitable device such as a topside pump, a skid-mounted pump, a subsea pump, etc.

Figure 5:
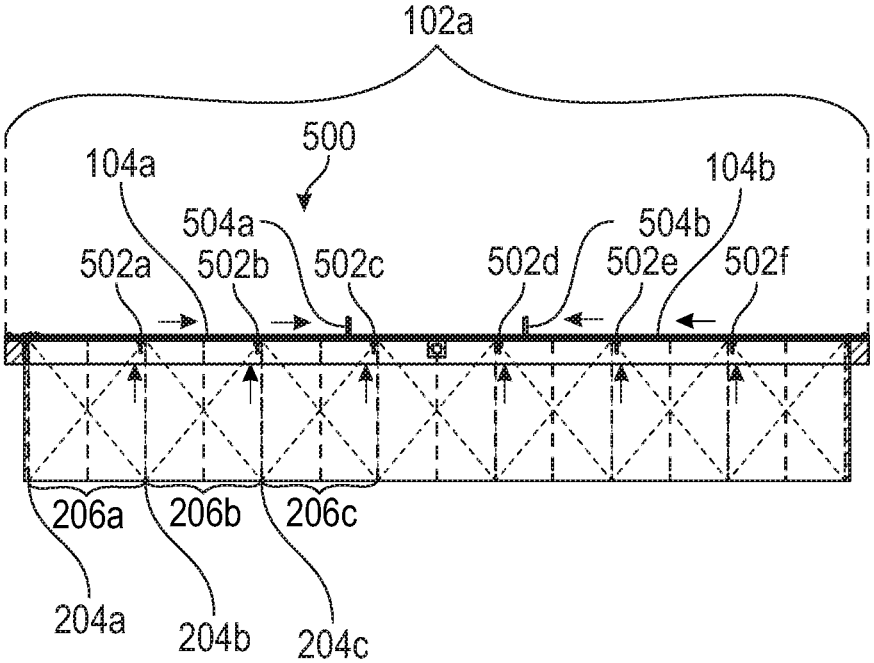
FIG. 5 is a cross-sectional view of a cofferdam structure including fluidic connections between a plurality of suction piles, in accordance with one or more embodiments of the disclosure.

FIG. 5 is a cross-sectional view 500 of a cofferdam structure including fluidic connections between a plurality of suction piles, in accordance with one or more embodiments of the disclosure. FIG. 5 shows a view similar to that of FIG. 3 that is defined by the cross section 3-3 of FIG. 2. As with FIG. 3, the view of FIG. 5 shows an internal surface of wall 102*a* and a cross section of wall 102*d*, as described above with reference to FIG. 3. As described above with reference to FIG. 2, wall 102*a* includes partitions 204*a*, 204*b*, 204*c*, etc., that divide wall 102*a* into a plurality of hollow regions 206*a*, 206*b*, 206*c*, etc. Each of regions 206*a*, 206*b*, 206*c*, etc., is configured as a suction pile similar to the suction pile structure (e.g., hatched region) of FIG. 4.

In further embodiments, regions 206*a*, 206*b*, 206*c*, etc., may be formed by welding a plurality of rectangularly-shaped suction piles together to form wall 102*a*. As described above with reference to FIG. 4, each region 206*a*, 206*b*, 206*c*, etc., may be provided with one or more fluidic conduits. In this example, fluidic conduits 502*a* to 502*f* are shown. Each of fluidic conduits 502*a* to 502*f* provide a fluidic pathway through which water may be pumped out of the various suction pile structures formed by regions 206*a*, 206*b*, 206*c*, etc. Fluidic conduits 502*a* to 502*f* may be accessed individually by an ROV that provides separate fluidic connections to fluidic conduits 502*a* to 502*f*. In other embodiments, fluidic connections with fluidic conduits 502*a* to 502*f* may be made using any suitable device such as a topside pump, a skid-mounted pump, a subsea pump, etc.

Alternatively, one or more of the fluidic conduits 502*a* to 502*f* may be coupled together via one or more fluidic pipes or tubing 104*a* to 104*d*, as described above with reference to FIG. 1. Fluidic pipes or tubing 104*a* to 104*d* may further be connected by a manifold (not shown). For example, fluidic conduits 502*a* to 502*c* may be coupled via fluidic pipes or tubing 104*a*, while fluidic conduits 502*d* to 502*f* may be coupled via fluidic pipes or tubing 104*b*. Fluidic pipes or tubing 104*a* may be further coupled to fluidic port 504*a* and fluidic pipes or tubing 104*b* may be coupled to fluidic port 504*b*. Fluidic ports 504*a* and 504*b* may be configured to allow an ROV to make a fluidic connection with fluidic pipes or tubing 104*a* and 104*b*, respectively. In this way, an ROV may couple to the cofferdam structure of FIGS. 1 to 5 and to pump water from multiple suction pile structures simultaneously. In other embodiments, fluidic connections with fluidic ports 504*a* and 504*b* may be made using any suitable device such as a topside pump, a skid-mounted pump, a subsea pump, etc.

Figures 6A, 6B:
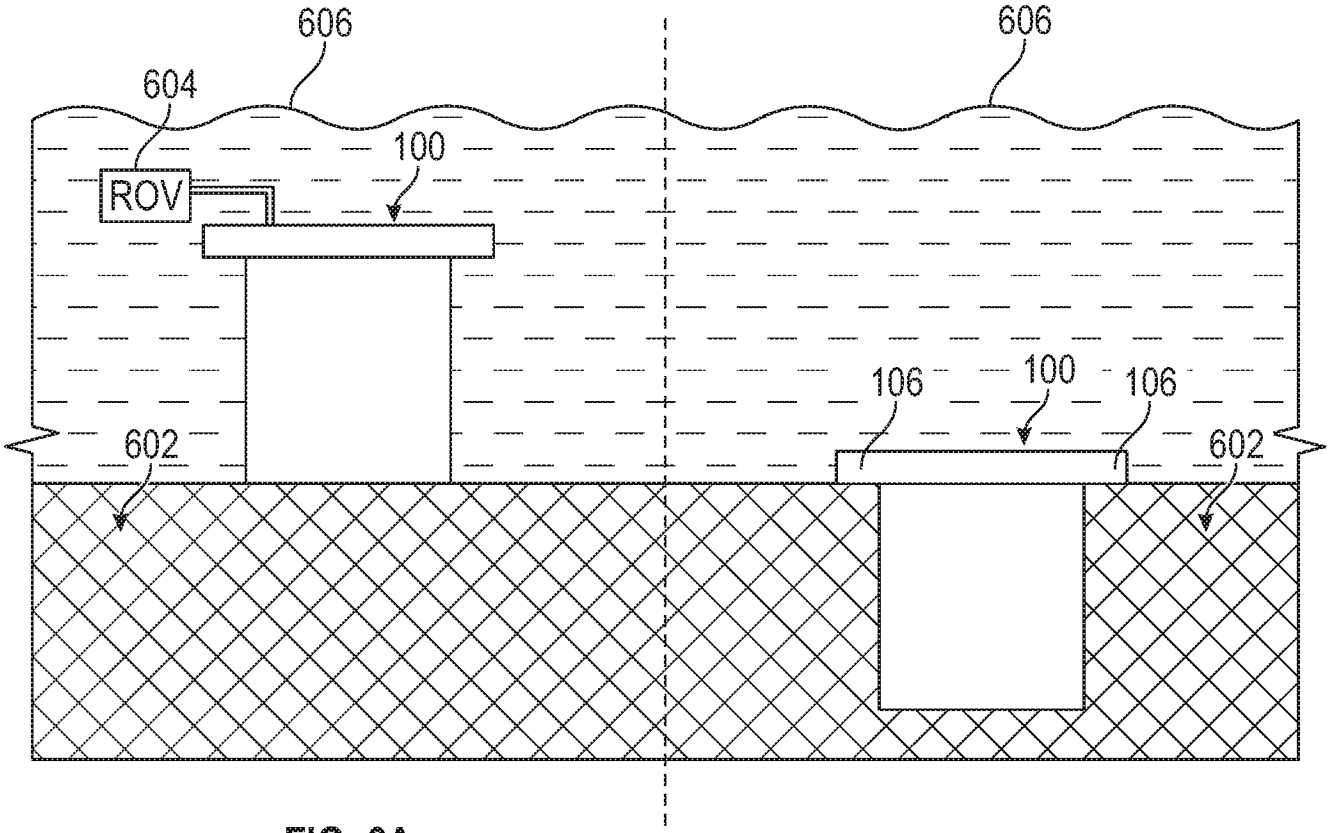
FIG. 6A illustrates an end view of a cofferdam structure including suction piles in a first configuration during installation, in accordance with one or more embodiments of the disclosure.
FIG. 6B illustrates an end view of a cofferdam structure including suction piles in a second configuration during installation, in accordance with one or more embodiments of the disclosure.

FIGS. 6A and 6B illustrate an end view of the cofferdam structure 100 of FIGS. 1 to 5 in first and second configurations during installation, in accordance with one or more embodiments of the disclosure. Cofferdam structure 100 may be installed using a process that starts with cofferdam structure 100 being lowered into the ocean. Fluidic structures (not shown in FIGS. 6A and 6B) may be opened while cofferdam structure 100 moves through water toward the ocean floor or to a subsea surface of mud or sediment 602. When cofferdam structure 100 comes to rest on a layer of mud or sediment 602 below a surface 606 of the ocean, water may be pumped out of cofferdam structure 100 by an ROV 604, as shown in FIG. 6A. In other embodiments, water may be pumped out of cofferdam structure 100 by any suitable device such as a topside pump, a skid-mounted pump, a subsea pump, etc. As described above, removal of water from cofferdam structure 100 induces negative pressure in the walls of cofferdam structure 100. After a certain amount of water is removed from the walls of cofferdam structure 100, fluidic ports (e.g., ports 504*a* and 504*b* of FIG. 5) may be closed to make a watertight connection to thereby maintain the negative pressure that develops in the walls of cofferdam structure 100.

Pressure of water above cofferdam structure 100 then forces cofferdam structure 100 into the layer of mud or sediment 602. As shown in FIG. 6B, cofferdam structure 100 may come to rest in a configuration in which extended structures 106 make contact with a surface of the mud or sediment 602 on the ocean floor. In this way, extended structures 106 may serve as a mud mat. Specific dimensions of cofferdam structure 100 may be chosen based on a particular application. For example, the height H (e.g., see FIG. 1 and related description) may be chosen based on a height of a particular thickness of mud or sediment 602 on the ocean floor, as described in greater detail below with reference to FIG. 7.

Figure 7:
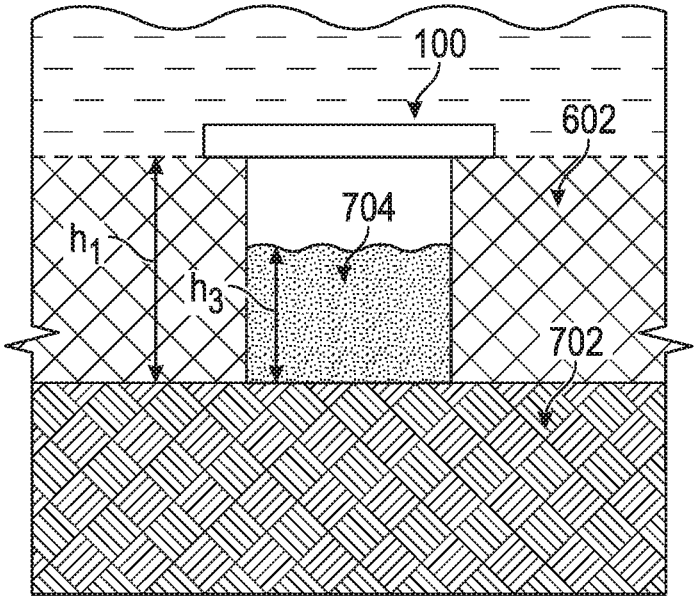
FIG. 7 illustrates an end view of a cofferdam structure including suction piles in which the height of the cofferdam structure is chosen based on a thickness of a sediment layer, in accordance with one or more embodiments of the disclosure.

FIG. 7 illustrates an end view of cofferdam structure 100 including suction piles in which a height h1 of the cofferdam structure is chosen based on a thickness of a mud or sediment layer 602, in accordance with one or more embodiments of the disclosure. As described above with reference to FIG. 4, in one embodiment, cofferdam structure 100 may have a height h1 that is approximately 100 feet. Such an embodiment may be advantageous for an application in which a sediment layer may have a thickness that is approximately 100 feet thick. The designation of height h1 being approximately 100 feet is merely an example and does not imply any limitation, and other embodiments may have other dimensions for comparable features. In this configuration, cofferdam structure 100 may be forced down through sediment layer 602 and may come to rest on a lower layer 702 that may have increased mechanical properties (e.g., layer 702 may be a sediment layer with an increased density or layer 702 may be bedrock).

The configuration of FIG. 7 allows mud or sediment 704 to be removed (i.e., excavated) from an internal space of cofferdam structure 100. In this example, mud or sediment 704 has been removed leaving a thickness h3 of mud or sediment 704. As described above, h1 may be approximately 100 feet. The thickness h3 of remaining mud or sediment 704 after excavation may be approximately 80 feet. These specific dimensions are merely an example and do not imply any limitation. Indeed, other embodiments may have other dimensions for comparable features. In order to maintain stability of cofferdam structure 100, it may be necessary to leave a thickness h3 of sediment within cofferdam structure 100 to maintain a seal that prevents material external to cofferdam structure 100 from entering cofferdam structure 100. If additional sediment 704 needs to be removed for a certain application, one or more additional smaller cofferdams may be installed, as described in further detail below with reference to FIG. 8.

Figure 8:
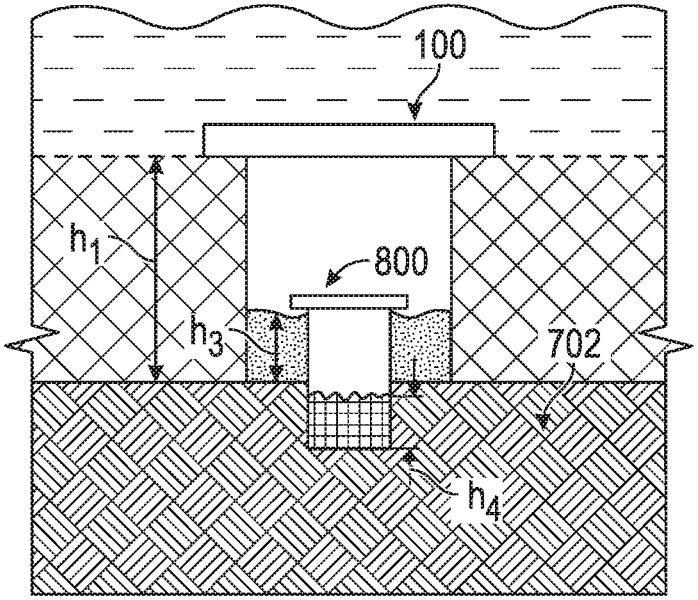
FIG. 8 illustrates a second cofferdam structure installed within a first cofferdam structure, in accordance with one or more embodiments of the disclosure.

FIG. 8 illustrates a second cofferdam structure 800 within the first cofferdam structure 100, in accordance with one or more embodiments of the disclosure. This embodiment makes it possible to remove more sediment than was removed in the example above (i.e., described with reference to FIG. 7). In this regard, it may be necessary to leave at least a thickness h3 of sediment to maintain stability of cofferdam structure 100. For an operation requiring removal of additional sediment, a second cofferdam structure 800 having suction piles may be installed. As shown, this second cofferdam structure 800 may allow removal of an additional amount of sediment down to a thickness of h4. Further, the presence of second cofferdam structure 800 allows material to be removed down to a depth that is lower than the bottom of cofferdam structure 100, as shown. In this example, h4 may have a height that is in a range from approximately 0 to 80 feet. These specific dimensions are merely an example and do not imply any limitation. Indeed, other embodiments may have other dimensions for comparable features as needed for various applications.

Figure 9:
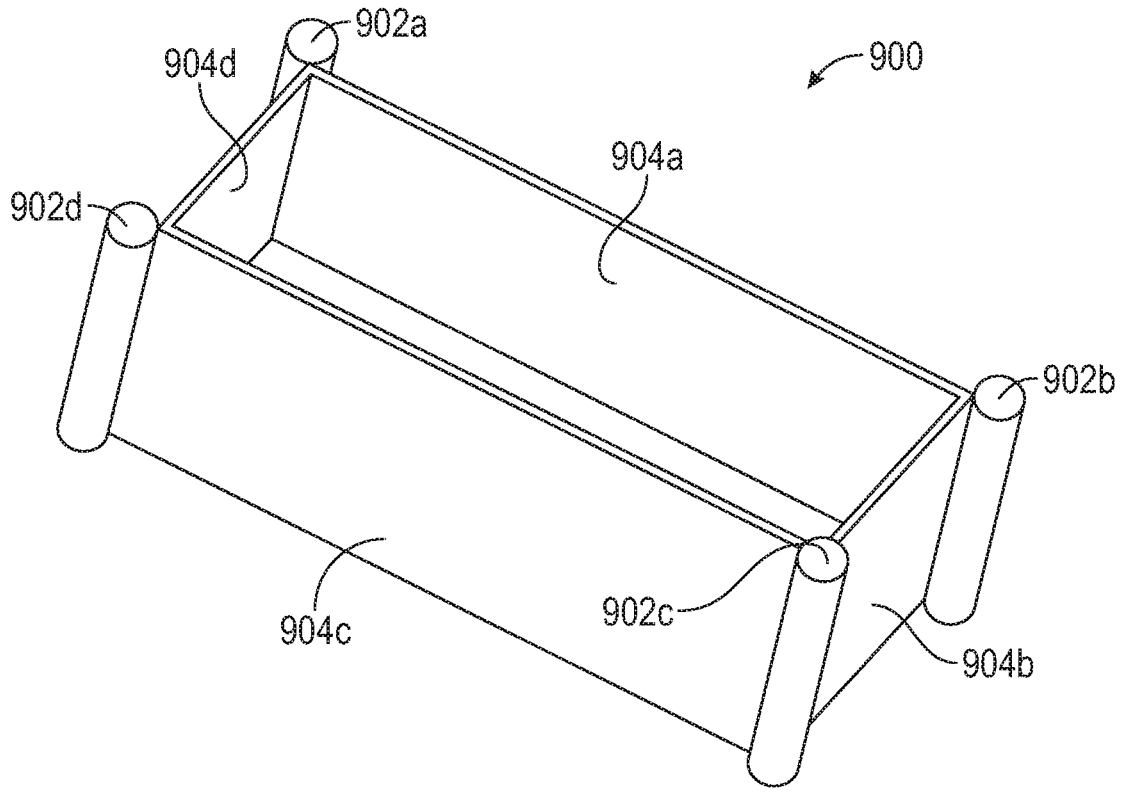
FIG. 9 is a three-dimensional perspective view of a cofferdam structure including suction piles, in accordance with one or more embodiments of the disclosure.

FIG. 9 is a three-dimensional perspective view of a further cofferdam structure 900 including suction piles, in accordance with one or more embodiments of the disclosure. In contrast to the cofferdam structure 100 of FIGS. 1 to 8, cofferdam structure 900 includes suction piles 902*a* to 902*d* attached to a frame structure that includes four walls 904*a* to 904*d*. In this regard, suction piles 902*a* to 902*d* and walls 904*a* to 904*d* may be steel structures that are fastened together. For example, walls 904*a* to 904*d* may be welded together to form a rectangular frame structure. In further embodiments, walls 904*a* to 904*d* may be attached to one another using various fasteners, such as bolts, rivets, etc. Further, suction piles 902*a* to 902*d* may be attached to walls 904*a* to 904*d* by welding or may be attached using various fasteners, such as bolts, rivets, etc. In other embodiments, suction piles 902*a* to 902*d* and walls 904*a* to 904*d* may be made of any other suitable structural material.

FIG. 9 illustrates an embodiment in which suction piles 902*a* to 902*d* are attached to corners of a rectangular frame structure that includes walls 904*a* to 904*d*. Further embodiments may include many different configurations of walls and suction piles. For example, the frame structure need not be a rectangular structure as shown in FIG. 9, but rather, may be a circle, an oval, a square, a triangle, a pentagon, a hexagon, or other multi-sided polygon. In additional embodiments, the frame structure may take any shape (e.g., a shape of a ship) as needed for a particular application. Further embodiments may include greater or fewer suction piles. For example, although FIG. 9 is shown with four circular suction piles 902*a* to 902*d*, other embodiments may have one, two, three, five, six, etc., suction piles. Further, suction piles need not have a cylindrical shape as shown in FIG. 9. In other embodiments, suction piles may have a rectangular shape, a square shape, a triangular shape, a pentagonal shape, a hexagonal shape, or may be another multi-sided polygon. Further, suction piles need not be attached to external surfaces of the rectangular frame structure of FIG. 9 but may be attached on internal surfaces, may be attached on a mixture of internal and external surfaces, or may be configured to be part of internal structures of cofferdam structure 900, as was the case with the embodiments described above with reference to FIGS. 1 to 8.

Conditional language, such as, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

The specification and annexed drawings disclose examples of cofferdams having suction piles. The examples illustrate various features of the disclosure, but those of ordinary skill in the art may recognize that many further combinations and permutations of the disclosed features are possible. Accordingly, various modifications may be made to the disclosure without departing from the scope or spirit thereof. Further, other embodiments of the disclosure may be apparent from consideration of the specification and annexed drawings, and practice of disclosed embodiments as presented herein. Examples put forward in the specification and annexed drawings should be considered, in all respects, as illustrative and not limiting. Although specific terms are employed herein, they are used in a generic and descriptive sense only, and not used for purposes of limitation.

What is claimed is:

1. A cofferdam comprising: at least one open frame structure having at least an inner wall and an outer wall defining a space between the inner wall and the outer wall, two side walls between the inner wall and the outer wall, and the open frame structure having an open bottom end and a closed top end, end; a fluidic conduit comprising at least two perforated pipes of unequal length with each perforated pipe including a plurality of apertures; the fluidic conduit is configured to connect with an external device to allow the external device to pump a liquid out of the space, and wherein the liquid in the space is at least partially removed to induce negative pressure to have in the at least one open frame structure act as a suction pile and sink the cofferdam in a ground surface.

2. The cofferdam of claim 1 wherein the external device is a remote-operated vehicle (ROV), a topside pump, a skid-mounted pump, or a subsea pump.

3. The cofferdam of claim 1 wherein, after at least some of the liquid is removed, the fluidic conduit can be closed to make a watertight configuration.

4. The cofferdam of claim 1 further including an extended structure at the closed top end with the extended structure extending away from the outer wall.

5. The cofferdam of claim 4 wherein the extended structure is a mud mat.

6. The cofferdam of claim 5 wherein the mud mat includes an additional space adjacent the space.

7. The cofferdam of claim 6 wherein the space has a thickness of 4 feet, a height of 100 feet and the additional space of the mud mat has a thickness of 20 feet and a height of 20 feet.

8. The cofferdam of claim 6 wherein the open frame structure has a length that is approximately 750 feet, a width that is approximately 150 feet, and a height from approximately 120 feet to approximately 150 feet.

9. A cofferdam comprising: a plurality of open frame structures enclosing an open region, each at least one open frame structure having at least an inner wall and an outer wall defining a space between the inner wall and the outer wall, two side walls between the inner wall and the outer wall, and the open frame structure having an open bottom end and a closed top end, end; each of the plurality of open frame structures is fluidly connected to at least one other open frame structure and comprises a fluidic conduit configured to allow removal of the liquid from the space; the fluidic conduit comprising at least two perforated pipes of unequal length with each perforated pipe including a plurality of apertures; the fluidic conduit of each of the plurality of open frame structures is configured to connect with an external device to allow the external device to pump a liquid out of the space of each of the plurality of open frame structures, and wherein the liquid in the space is at least partially removed to induce negative pressure to have in the at least one open frame structure act as a suction pile and sink the cofferdam in a ground surface.

10. The cofferdam of claim 9 wherein the external device is a remote-operated vehicle (ROV), a topside pump, a skid-mounted pump, or a subsea pump.

11. The cofferdam of claim 9 wherein, after at least some of the liquid is removed, the fluidic conduit can be closed to make a watertight configuration.

* * * * *